United States Patent [19]

Wu

[11] Patent Number: 4,921,640

[45] Date of Patent: May 1, 1990

[54] VENTURI-TUBE BUBBLE-FORMING CONTAINER

[76] Inventor: Tsann-Kuen Wu, No. 140-10, Che-Lu-Chien, Pau-An Tsun, Jen-Te Hsiang, Tainan Hsien, Taiwan

[21] Appl. No.: 348,718

[22] Filed: May 8, 1989

[51] Int. Cl.[5] ..... B01F 3/04

[52] U.S. Cl. ..... 261/76; 99/293

[58] Field of Search ..... 99/279, 293, 294; 261/76

[56] References Cited

U.S. PATENT DOCUMENTS

| | | | |
|---|---|---|---|
| 627,885 | 6/1899 | Viser | 99/293 |
| 1,588,769 | 6/1926 | Parker | 99/293 |
| 2,709,577 | 5/1955 | Pohndort et al. | 261/76 |
| 3,641,918 | 2/1972 | Schellgell et al. | 99/279 |
| 3,900,420 | 8/1975 | Sebba | 261/76 |
| 4,322,292 | 3/1982 | Knox | 261/76 |
| 4,660,466 | 4/1987 | Fries et al. | 99/294 |
| 4,752,383 | 6/1988 | McKay et al. | 261/76 |
| 4,834,782 | 5/1989 | Silva | 261/76 |

*Primary Examiner*—Tim Miles

*Attorney, Agent, or Firm*—Handal & Morofsky

[57] ABSTRACT

A bubble-forming container has a venturi-tube type inlet unit which can rapidly draw a beverage into the body of the container. A blocking plate is disposed in the container body in alignment with the inlet of the container so that the liquid forming the beverage can pound against the blocking plate, thereby splashing to the inner wall of container body. A cylinder stands on the lower end wall of the container body. The liquid whirls around the cylinder and flows out of the container through an opening which is formed in the cylinder.

5 Claims, 6 Drawing Sheets

VENTURI-TUBE BUBBLE-FORMING CONTAINER

BACKGROUND OF THE INVENTION

This invention relates to a bubble-forming apparatus, more particularly to a venturi-tube type bubble-forming container.

The high-pressure vapor produced by espresso coffee makers has been used for drawing a beverage, such as milk and juice, into a container so as to bubble the same according to the principle of venturi tube. The improvement of this invention is directed to a conventional venturi-tube type bubble-forming container such as that shown in FIGS. 1 and 2. As illustrated, the container C includes a vertical connecting pipe Cl secured to the upper end thereof which engages with the vapor or main pipe B of an espresso coffee maker A. The container C has a funnel-like inlet C2 which forms the throat of the vapor passage. A branch pipe C3 is provided in communication with the inlet C2 and a beverage container so that, when high-pressure vapor flows from the coffee maker A into the interior chamber C5 of the container C, the beverage is drawn into the chamber C5. When the steam of the beverage pounds on the inner wall of the container C, a turbulence is created in the liquid forming the beverage so as to form bubbles in the beverage. A vent hole C4 is also communicated with the inlet C2 of the container C. A discharge pipe C6 is provided at the lower end of the container C and is used for entry of the bubbled liquid into a collecting glass which is disposed immediately below the discharge pipe C6. A portion of the liquid from the inlet C2 directly flows into the discharge C6 and thus hardly forms bubbles. Although the remaining portion of the liquid flows along the inner wall of the container C, the period of moving the liquid in the container C is too short to efficiently form bubbles.

SUMMARY OF THE INVENTION

An object of this invention is to provide a bubble-forming container in which all of the liquid flows along the inner wall of the container before it flows out of the container.

Another object of the invention is to provide a bubble-forming container which can increase the period of moving the liquid in the container so as to form a greater amount of bubbles.

According to this invention, a bubble-forming container includes a body with an interior chamber, a venturi-tube type inlet unit and a discharge pipe unit. The inlet unit includes a main pipe with a throat for passage of a high-pressure gas therethrough, a branch pipe communicated with the throat of the main pipe so as to draw a liquid into the throat, and an inlet formed through the upper wall of the body in communication with the main pipe so that a fluid combined from the gas and the liquid can flow quickly and downward into the chamber The discharge pipe unit includes a discharge pipe extending through the lower wall of the body in such a manner that a liquid-tight seal is established between the body and the discharge pipe, a blocking plate sealing the upper end of the discharge pipe, and an opening formed through the discharge pipe which intercommunicates the chamber and said discharge pipe, the blocking plate being positioned so that a stream of the fluid can flow from the inlet to pound on the upper surface of the blocking plate. When the blocking plate disperses the fluid so that a turbulence is created in the liquid in the chamber, bubbles are formed in the liquid and flow out of the chamber through the opening. Preferably, the upper surface of the blocking plate includes a concavity formed therein which has an inclined wall so as to easily disperse the fluid.

BRIEF DESCRIPTION Of THE DRAWINGS

Other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
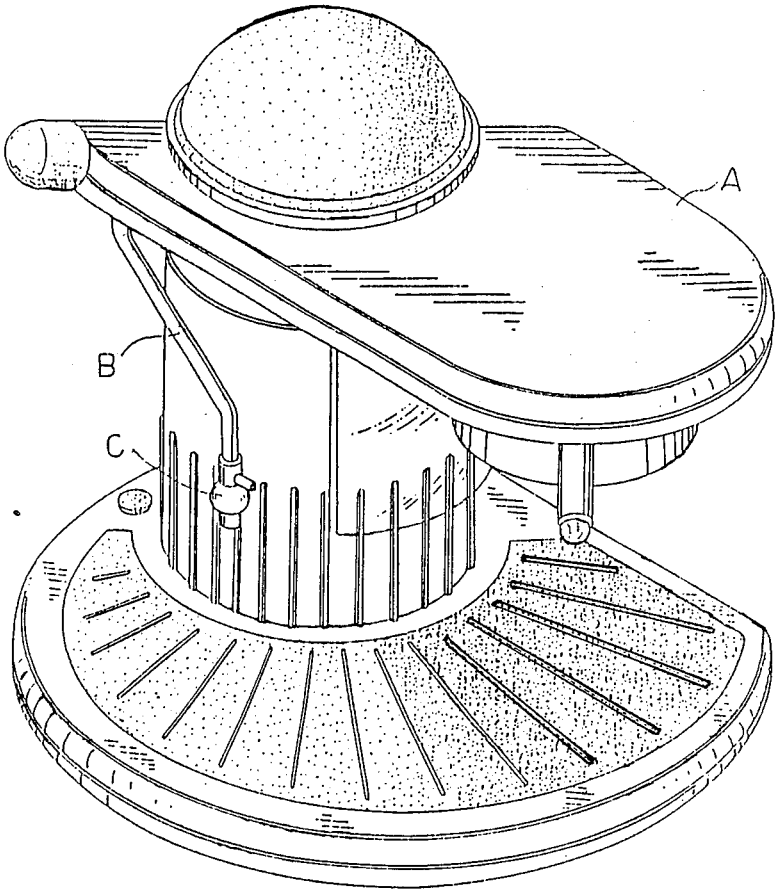
FIG. 1 (PRIOR ART)
FIG. 1 is a perspective view of a conventional bubble-forming container.
Figure 2:
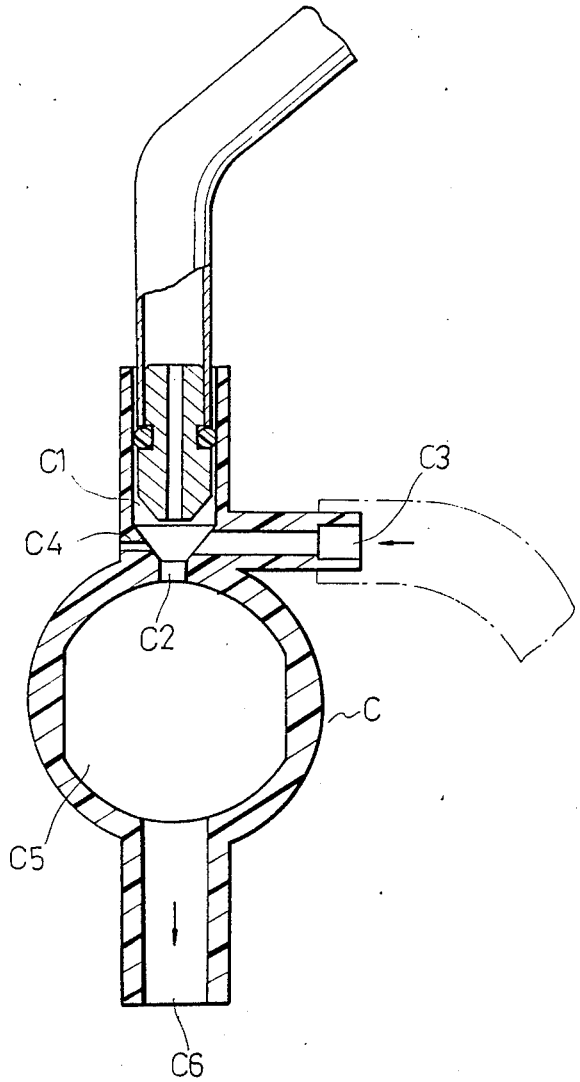
FIG.2 (PRIOR ART)
FIG. 2 is a sectional view of the conventional bubble-forming container.
Figure 3:
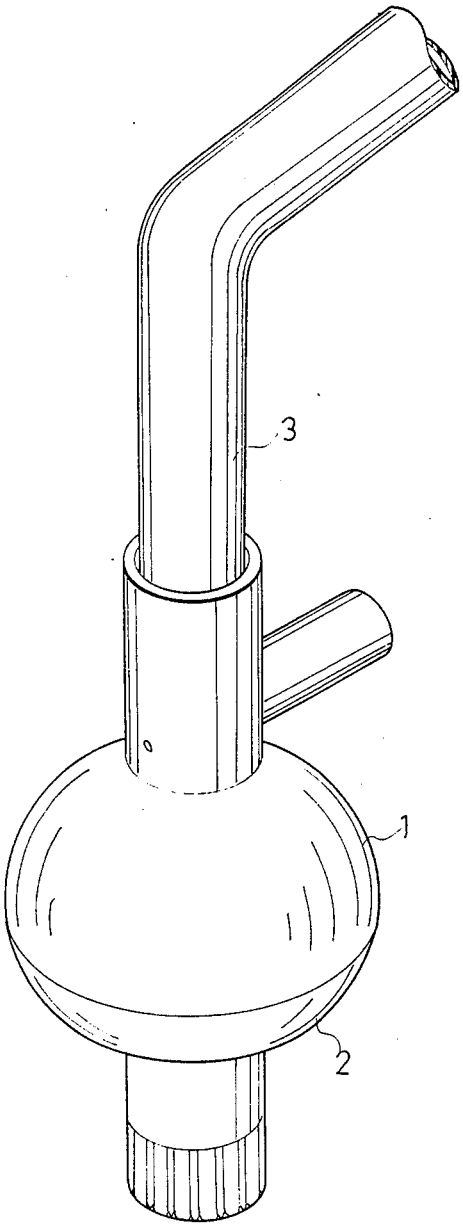
FIG. 3 is a perspective view of a bubble-forming container according to this invention.
Figure 4:
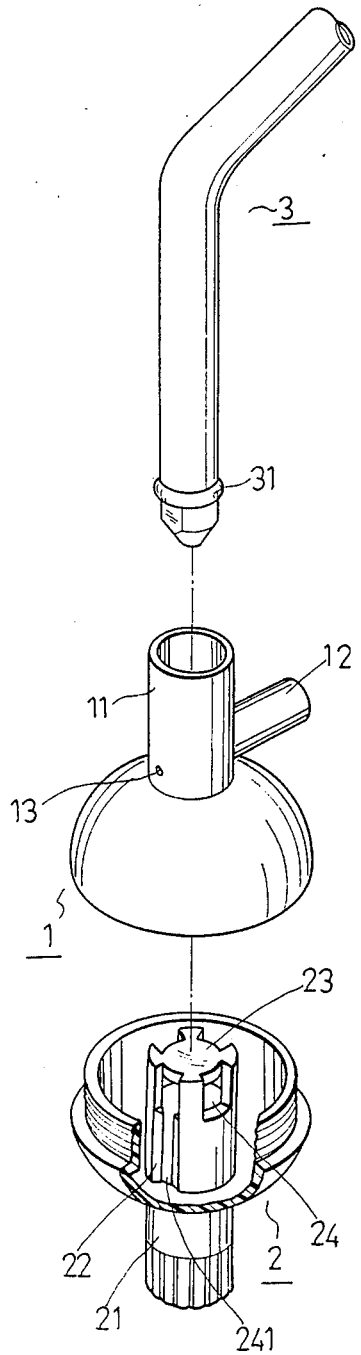
FIG. 4 is an exploded view showing the bubble-forming container of this invention.
Figure 5:
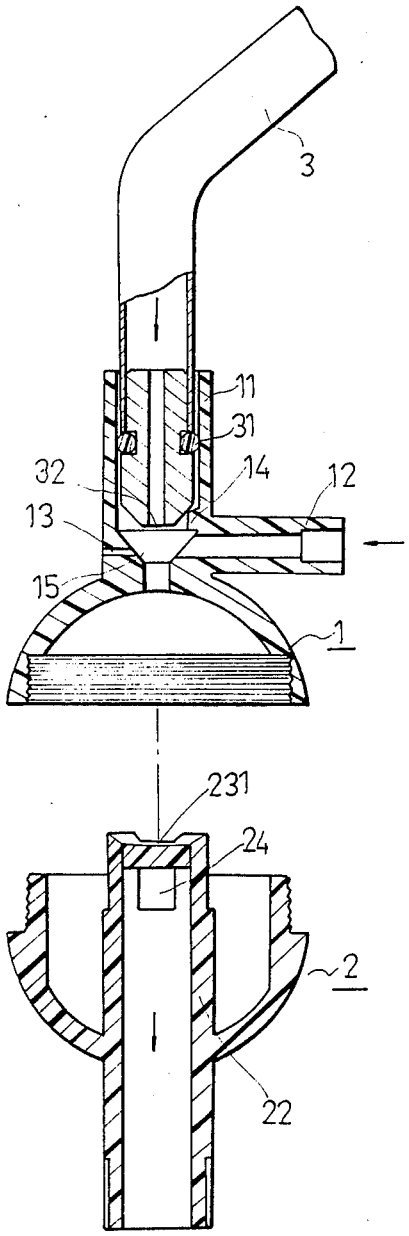
FIG. 5 is a sectional view showing the bubble-forming container of this invention.

Referring to FIGS. 3–6, a bubble-forming container of this invention includes a spherical container body consisting of an upper half 1 and a lower half 2. The upper half 1 has an internally threaded lower end, while the lower half 2 has an externally threaded upper end so as to couple with said upper half 1. A vertical connecting pipe 11 extends upward from the upper end of the upper half 1. A branch pipe 12 extends laterally from the connecting pipe 11. The connecting pipe 11 includes a vent hole 13 formed through one wall thereof in alignment with the branch pipe 12, and three equally spaced-apart projections 14 extending radially and inwardly from the inner wall of the connecting pipe 11. A vapor or main pipe 3 is inserted into the connecting pipe 11 and has a tapered lower end which engages the projections 14 with the inclined wall thereof. An O-ring 31 is received within the annular groove of the main pipe 3 so as to establish a liquid-tight seal between the main pipe 3 and the connecting pipe 11. The container body has a funnel-like inlet 15 which registers with the outlet 32 of the main pipe 3.

A vertical discharge pipe 21 extends through the lower end wall of the lower half 2 and is in line with the connecting pipe 11 so as to form a cylinder 22 in the interior chamber of the container. A blocking plate 23 is fixed on the cylinder 22 so as to seal the upper end opening of the discharge pipe 21. A concavity 231 is formed in the upper surface of the blocking plate 23 in registry with the inlet 15 and is defined by an inclined wall. The cylinder 22 has three aligned rectangular openings 24 formed in the upper end portion thereof, and a slot 241 which extends axially along the full length of the cylinder 22 and thus intersects the inner wall of the container.

The branch pipe 12 extends into the beverage in a container. When high-pressure vapor flows through the connecting pipe 11, the beverage is drawn into the interior chamber of the container body through the inlet 15 in accordance with the principle of venturi tube and pounds on the blocking plate 23. Because the liquid forming the beverage is entrained by the vapor flowing through the inlet 15, the temperature of the beverage is increased. Then, the hot or warm beverage splashes on the inner wall of the container body forming a turbulence which whirls the liquid around the cylinder 22. As a result, a large amount of bubbles are formed in the liquid. Finally, the bubbled liquid flows into the discharge pipe 21 through the openings 24 and slot 241. Certainly, most of the beverage flows through the slot 241.

Figure 7:
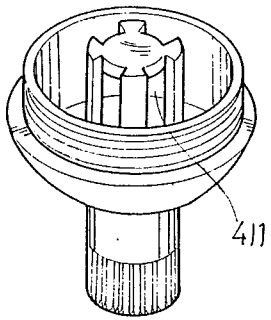
FIG. 7 is a perspective view showing a modified lower container body of the bubble-forming container according to this invention.
Figure 6:
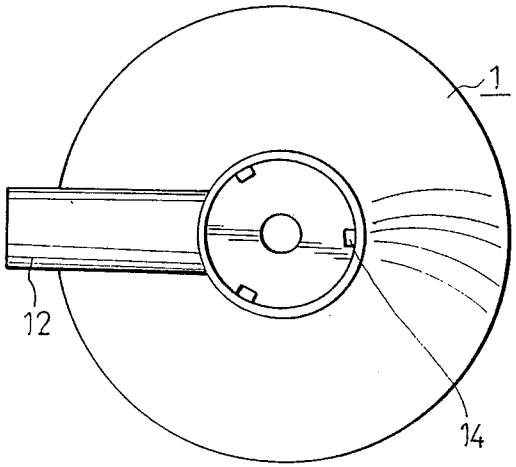
FIG. 6 is a top view showing the upper container body, the connecting pipe and the branch pipe of the bubble-forming container according to this invention.

Referring to FIG. 7, instead of the openings 24, three slots, all of which are similar to the slot 241 in construction, may be formed in the cylinder 22.

It can be appreciated that the container of this invention has the following advantages:

(1) With the blocking plate 22 positioned in registry with the inlet 15, the liquid from the inlet 15 cannot directly flow into the discharge pipe 21.

(2) Because the blocking plate 22 disperses the liquid, the latter can flow in the container body for an extended period so as to form a large amount of bubbles therein.

(3) The arrangement of the projections 14 and the tapered lower end of the main pipe 3 facilitates the interconnection of the connecting pipe 11 and the main pipe 3.

(4) It is easy to separate the upper half 1 from the lower half 2 for cleaning With this invention thus explained, it is apparent that numerous modifications and variations can be made without departing from the scope and spirit of this invention. It is therefore intended that this invention be limited only as indicated in the appended claims.

I claim:

1. A bubble-forming container including a body with an interior chamber formed in said body, a venturi-tube type inlet unit and a discharge pipe unit, said inlet unit including a main pipe with a throat for passage of a high-pressure gas therethrough, a branch pipe communicated with said throat of said main pipe so as to draw a liquid into said throat, and an inlet formed through an upper wall of said body in communication with said main pipe so that a fluid combined from said gas and said liquid can flow quickly downward into said chamber, said discharge pipe unit including a discharge pipe extending through a lower wall of said body in such a manner that a liquid-tight seal is established between said body and said discharge pipe, a blocking plate sealing an upper end of said discharge pipe, and an opening formed through said discharge pipe intercommunicating said chamber and said discharge pipe, said blocking plate being positioned so that a stream of said fluid can flow from said inlet to pound on an upper surface of said blocking plate, whereby, when said blocking plate disperses said fluid so that a turbulence is created in said liquid in said chamber, bubbles are formed in said liquid and flow out of said chamber through said opening.

2. A bubble-forming container as claimed in claim 1, wherein said opening is a slot which extends axially in an upper end portion of said discharge pipe and intersects an inner wall of said body.

3. A bubble-forming container as claimed in claim 1, wherein said upper surface of said blocking plate includes a concavity formed therein which has an inclined wall so as to easily disperse said fluid.

4. A bubble-forming container as claimed in claim 1, said body has a vertical connecting pipe secured to an upper end thereof, said connecting pipe having a plurality of equally spaced-apart projections extending therefrom in a horizontal plane, said main pipe including an annular groove formed therein, an O-ring received within said annular groove so as to establish a liquid-tight seal between said main pipe and said connecting pipe, and a tapered lower end engaging said projections with side walls thereof.

5. A bubble-forming container as claimed in claim 1, wherein said body includes a hollow upper half and a hollow lower half, one of said upper and lower halves having an internally threaded annular end portion, the other of said upper and lower halves having an externally threaded annular end portion engaged with said internally threaded annular end portion so as to define said chamber between said upper and said lower halves.

* * * * *